US005655470A

United States Patent [19]

Tajima et al.

[11] Patent Number: 5,655,470

[45] Date of Patent: Aug. 12, 1997

[54] SEWING MACHINE WITH MOVABLE PRESSER FOOT

[75] Inventors: Ikuo Tajima; Satoru Suzuki; Youichi Mizuguchi, all of Kasugai, Japan

[73] Assignee: Tokai Kogyo Mishin Kabushiki Kaisha, Kasugai, Japan

[21] Appl. No.: 675,015

[22] Filed: Jul. 3, 1996

[30] Foreign Application Priority Data

Jul. 6, 1995 [JP] Japan ..... 7-171020

[51] Int. Cl.[6] ..... D05C 09/20; D05C 11/20; D05B 29/08

[52] U.S. Cl. ..... 112/236; 112/163; 112/283; 112/253

[58] Field of Search ..... 112/100, 163, 112/236, 239, 235, 286, 253

[56] References Cited

U.S. PATENT DOCUMENTS 133,411 11/1872 Coles et al. ..... 112/235

3,282,237 11/1966 Niekrawietz ..... 112/236

5,255,623 10/1993 Sato et al. ..... 112/286

FOREIGN PATENT DOCUMENTS 2125766 12/1972 Germany ..... 112/236

2745977 4/1979 Germany ..... 112/163

*Primary Examiner*—Ismael Izaguirre

*Attorney, Agent, or Firm*—Dennison, Meserole, Pollack & Scheiner

[57] ABSTRACT

A sewing machine has at least one sewing head having a presser foot which is vertically reciprocally moved by a predetermined stroke in synchronism with a vertical movement of a needle bar. After completion of the sewing operation, an upper thread is cut in a position spaced by a suitable distance from a sewing needle mounted on the needle bar. A refuge mechanism is operable to move the presser foot to a refuge position for giving refuge to a part of the upper thread on the side of the sewing needle cut after completion of the sewing operation. The refuge position is out of the predetermined stroke.

8 Claims, 10 Drawing Sheets

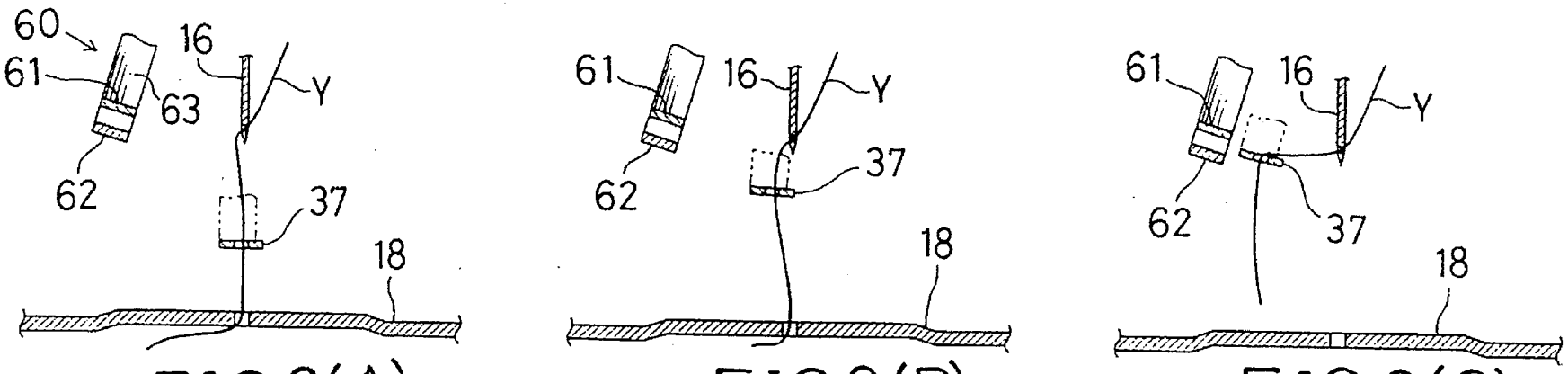
FIG.6(A)
FIG.6(B)
FIG.6(C)
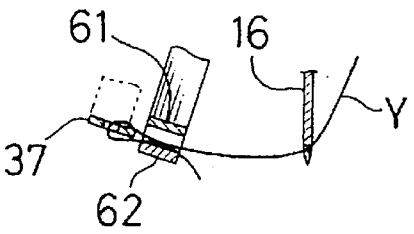
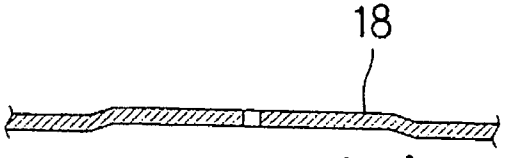
FIG.6(D)
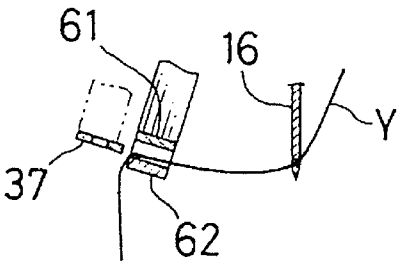
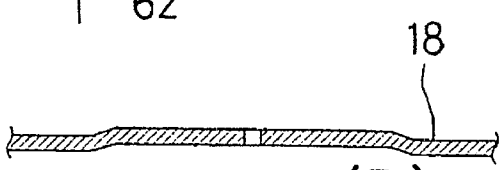
FIG.6(E)

SEWING MACHINE WITH MOVABLE PRESSER FOOT

FIELD OF THE INVENTION

The present invention relates to a sewing machine having a sewing head in which a presser foot is vertically reciprocally moved and in which an upper thread is cut after completion of the sewing operation.

DESCRIPTION OF THE PRIOR ART

A conventional sewing machine has a sewing head which includes a thread cutting device for cutting an upper thread in a position below a throat plate after completion of the sewing operation, so that the upper thread is separated into a part connected to a work fabric (hereinafter called "upper fabric thread") and a part connected to a sewing needle (hereinafter called "upper needle thread"). Since the cut end of the upper needle thread extends downwardly to reach an upper surface of the throat plate, the upper needle thread may hinder the operation for changing the work fabric to another one after the sewing operation. To this end, an upper thread refuge mechanism is provided for moving the upper needle thread to a position upward of the throat plate. The refuge mechanism has a hook member which is controlled to be slidably moved to engage the upper needle thread extending downwardly from the sewing needle and to give refuge to the upper needle thread.

However, since the thread refuge mechanism of the conventional sewing machine is provided exclusively for the purpose of giving refuge to the upper needle thread, the number of parts as well as the manufacturing costs of the sewing machine may increase although the operation for changing the work fabric may be smoothly performed.

SUMMARY OF THE INVENTION

It is, accordingly, an object of the present invention to provide a sewing machine having a sewing head in which a presser foot itself serves to give refuge to an upper needle thread, so that the number of parts as well as the manufacturing costs of the sewing machine is reduced.

It is another object of the present invention to provide a sewing machine having a sewing head which is operable to hold refuge of an upper needle thread.

It is a further object of the present invention to provide a sewing machine having a sewing head which is operable to interrupt the power transmission path between a main shaft and a presser foot when an upper needle thread is given refuge.

According to the present invention, in a sewing machine having at least one sewing head in which a presser foot is vertically reciprocally moved by a predetermined stroke in synchronism with a vertical movement of a needle bar and in which an upper thread is cut after completion of the sewing operation and in a position spaced by a suitable distance from a sewing needle mounted on the needle bar, the improvement comprising:

a refuge mechanism operable to move the presser foot to a refuge position for giving refuge to a part of the upper thread on the side of the sewing needle cut after completion of the sewing operation, the refuge position being out of the predetermined stroke.

With this construction, since the presser foot is utilized to give refuge to the upper thread, a separate hook member is not required for giving refuge to the upper thread, so that the sewing machine may have a simple construction.

If the sewing machine has a power transmission mechanism for converting the rotation of a main shaft into the vertical reciprocating movement of the presser foot, it is preferable that the refuge mechanism is operable to interrupt the power transmission path between the main shaft and the presser foot. Thus, both the operation for moving the presser foot to the refuge position and the operation for interrupting the transmission path may be performed by a simple construction.

This construction is particularly advantageous if the sewing machine has a plurality of such sewing heads which are driven by a single main shaft. Thus, when the selected sewing head(s) is driven while the remaining sewing head(s) is(are) not driven, the presser foot of each remaining sewing head can be held not to be reciprocally moved.

A thread engaging device may be provided on a moving path of the presser foot for receiving the part of the upper thread and for holding the same.

This construction is particularly advantageous if the sewing head has a plurality of needle bars. Thus, the cut end of the upper thread extending from each needle bar can be held by the thread engaging device.

The invention will become more apparent from the appended claims and the description as it proceeds in connection with the drawings.

BRIEF DESCRIPTION OF THE DRAWINGS

FIGS. 6(A) to 6(E) are explanatory views showing in sequence the refuge operation;

DETAILED DESCRIPTION OF THE PREFERRED EMBODIMENTS

A first and a second embodiment of the present invention will now be explained with reference to the drawings.

First Embodiment

Figure 1:
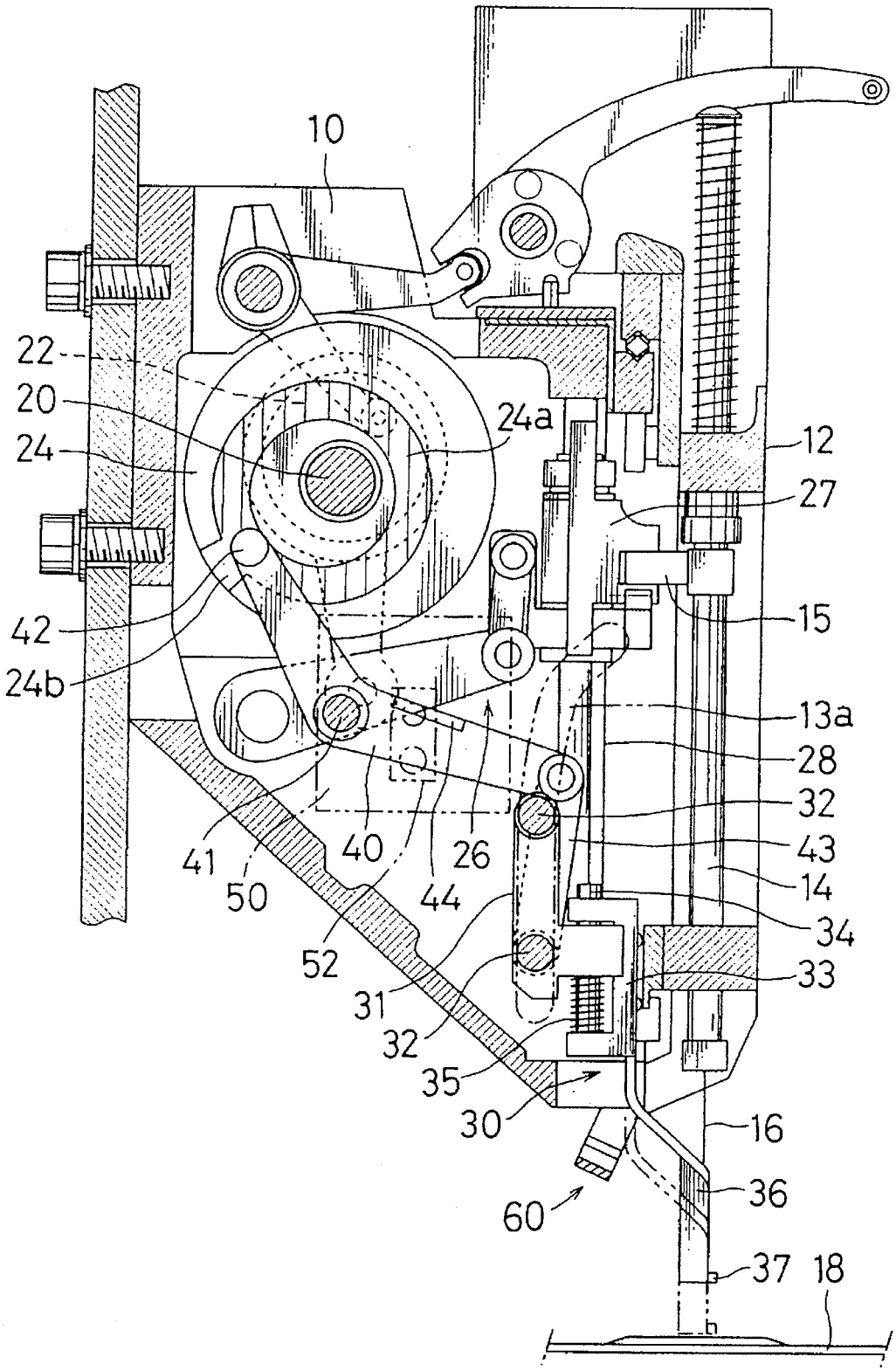
FIG. 1 is a side sectional view of a sewing head of a sewing machine according to a first embodiment of the present invention.

A multi-needle sewing head of a sewing machine is shown in side sectional view in FIG. 1. As shown in FIG. 1, the sewing head has a needle bar case 12 mounted on a front side (left side as viewed in FIG. 1) of a machine arm 10. The needle bar case 12 is slidably movable relative to the machine arm 10 in the widthwise direction of the sewing head by an actuator (not shown) under control. A plurality of needle bars 14 (only one is shown in the drawings) are mounted on the needle bar case 12 and are arranged in series in the direction of the sliding movement of the needle bar case 12. Each of the needle bars 14 is vertically slidably movable relative to the needle bar case 12 and has a sewing needle 16 attached to its lower end. In addition, each of the needle bars 14 has a needle bar holder 15 mounted thereon in the middle position in its longitudinal direction.

A main shaft 10 extends horizontally through the machine arm 10 and has a needle bar drive cam 22 and a presser foot drive cam 24 fixedly mounted thereon, respectively. When the main shaft 10 is rotated, a vertically movable member 27 is vertically reciprocally moved along a needle bar base 28 by means of a needle bar drive link 26 which is interlocked with the needle bar drive cam 22. The vertically movable member 27 is in engagement with one of the needle bars 14 selected by the sliding movement of the needle bar case 12, and the selected needle bar 14 is vertically reciprocally moved with the vertically movable member 27. A presser foot drive mechanism is interlocked with the presser foot drive cam 24 as will be explained later.

Figure 2:
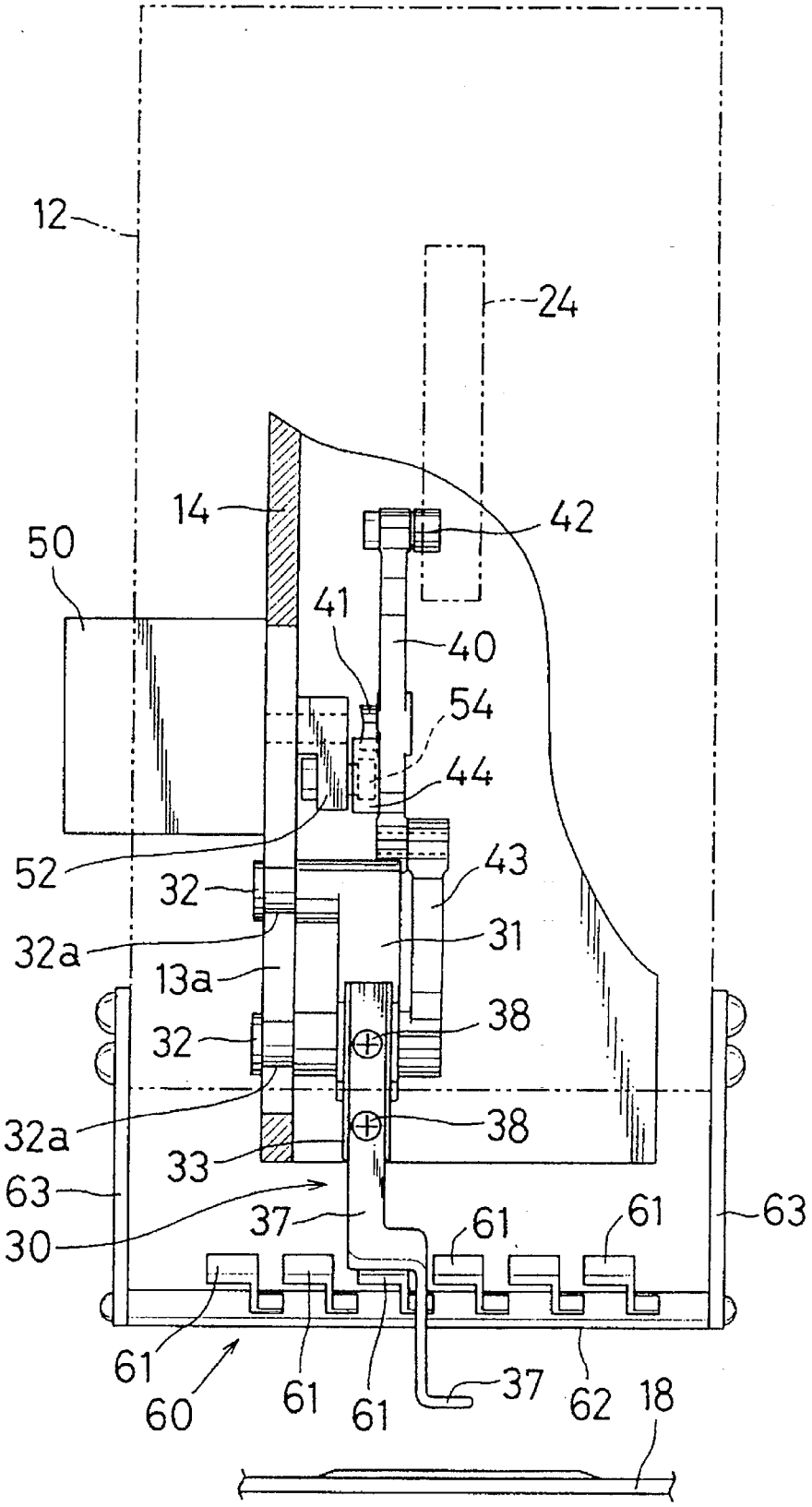
FIG. 2 is a front view of a presser foot unit and its associated mechanisms of the sewing head shown in FIG. 1.
Figure 3:
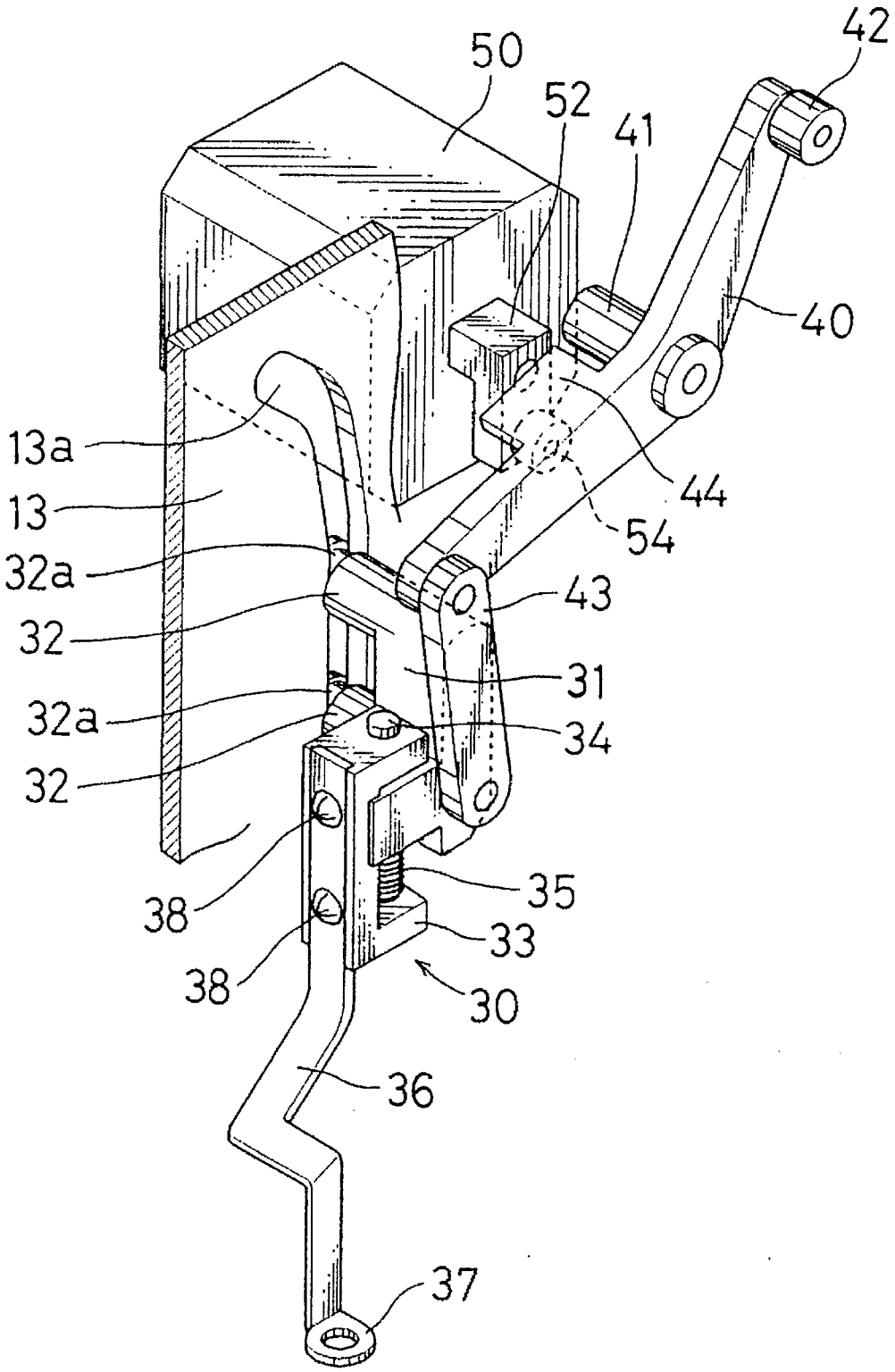
FIG. 3 is a perspective view of the presser foot unit and its associated mechanisms.

FIG. 2 is a front view of the sewing head and shows a presser foot unit 30 and its associated mechanisms which are also shown in FIG. 3 in perspective view. The presser foot unit 30 is shown in partial sectional view in FIG. 4.

As will be seen from these drawings, the presser foot unit 30 includes a vertically movable element 31 and a support element 33 as well as a presser foot 36.

The vertically movable element 31 includes one side surface having a pair of projections 32 formed integrally therewith and extend outwardly therefrom. The projections 32 are spaced from each other in the vertical direction. Each of the projections 32 has a front end having an annular circumferential groove 32*a* formed therein. A part of each projection 32 having the circumferential groove 32*a* is in engagement with a guide slot 13*a* formed in a side plate 13 which is fixed to the machine arm 10 on the left side as viewed in FIG. 2. With this construction, the vertically movable element 31 is slidably movable along the guide slot 13*a* relative to the side plate 13.

As shown in FIG. 1, the guide slot 13*a* has a lower part extending straightly in the vertical direction and an upper part curved in the direction forwardly (rightwardly as viewed in FIG. 1) of the sewing head.

Figure 4:
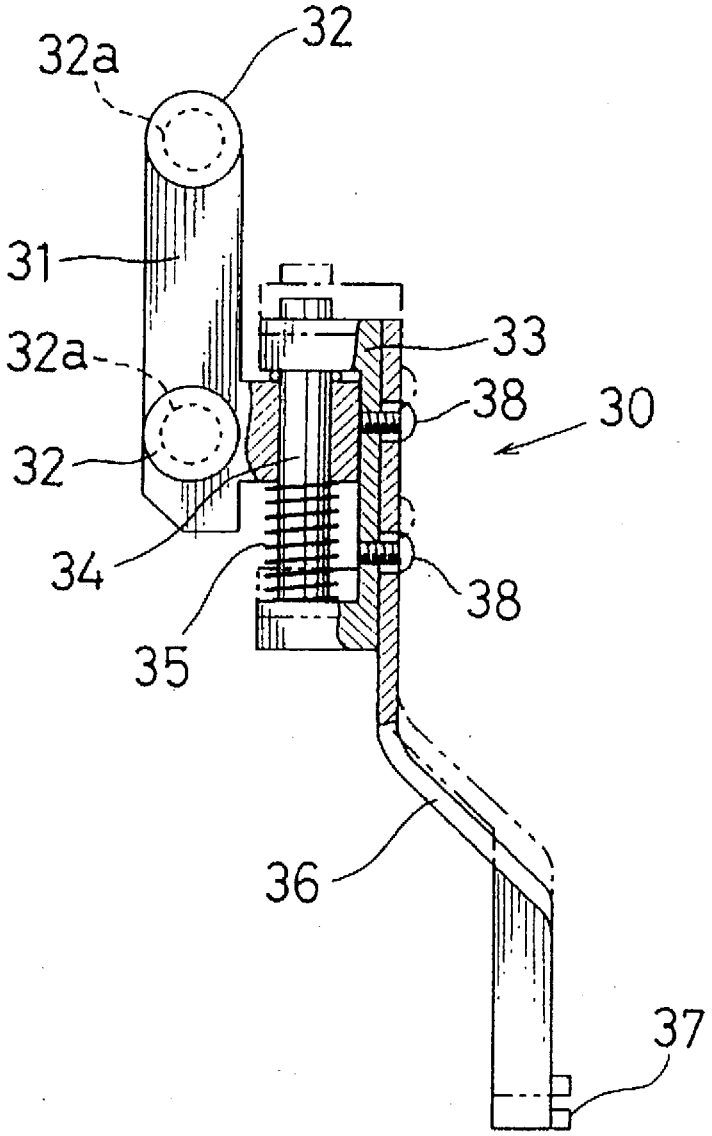
FIG. 4 is a sectional view of the presser foot unit.

As shown in FIG. 4, the support element 33 is fixed to upper and lower ends of a rod 34 which is vertically slidably inserted into the lower portion of the vertically movable element 31. The presser foot 36 has a foot part 37 at its lower end. The foot part 37 has a needle insertion hole (not shown) for permitting passage of the sewing needle 16 together with an upper thread supplied to one of the sewing needle 16 which has been selected as explained previously. The presser foot 36 is fixed to the front surface of the support element 33 by means of screws 38 which permit fine adjustment of the vertical position of the presser foot 36 relative to the support element 33.

A compression spring 35 is fitted on the rod 34 and is interposed between the lower portion of the vertically movable element 31 and the lower end of the support element 33 to which the lower end of the rod 34 is fixed, so that the support element 33 is normally biased by the spring 35 in the downward direction relative to the vertically movable element 31. As will be explained later, during the sewing operation, the presser foot unit 30 or the presser foot 36 is vertically reciprocally moved by a predetermined stroke. When the foot part 37 of the presser foot 36 is brought to collide with a work fabric at the lower dead center of the movement of the presser foot 36, the support element 33 is slidably moved upwardly relative to the vertically movable member 31 against the biasing force of the spring 35 as shown by chain lines in FIG. 4, so that the impact force which may be applied to the vertically movable member 31 is reduced.

The presser foot drive mechanism will now be explained. The presser foot drive cam 24 has a cam recess 24*a* formed therein. A cam follower 42 is mounted on one end of a drive arm 40 and is in engagement with the cam recess 24*a*. The drive arm 40 has the other end connected to the vertically movable element 31 by means of a lever 43. The drive arm 40 has a middle portion which is pivotally supported by the side plate 14 by means of a shaft 41. With this construction, when the presser foot drive cam 24 is rotated, the vertically movable element 31 is vertically reciprocally moved by the actuation of the drive arm 40 and the lever 43.

Here, as shown in FIG. 1, a cut-out recess 24*b* is formed in the presser foot drive cam 24. The cut-out recess 24*b* is in continuity with the cam recess 24*a* on one side and is opened to the outside on the other side, so that the cam follower 42 can be disengaged from the cam recess 24*a* through movement from the cam recess 24*a* to the outside via the cut-out recess 24*b*.

As will be best seen from FIG. 2, a pulse motor 50 serving as an actuator for moving the presser foot 36 to a refuge position is fixed to an outer side surface (left side surface as viewed in FIG. 2) of the side plate 13. An actuation arm 52 is fixed to an output shaft of the pulse motor 50 and has one end having a roller 54 supported thereon. The roller 54 is adapted to abut on the bottom side of an abutting member 44. The abutting member 44 is formed integrally with the drive arm 40.

As shown in FIGS. 1 and 2, a thread engaging member 60 is positioned below the needle bar case 12 and is adapted to engage the upper thread supplied to the selected sewing needle 16. The thread engaging member 60 includes a base plate 62 supported on the needle bar case 12 by means of brackets 63 which are fixed to the needle bar case 12 on both sides thereof, so that the thread engaging member 60 extends in the widthwise direction of the needle bar case 12. A plurality of thread engaging plates 61 which are the same in number as the needle bars 14 are fixedly mounted on the base plate 62. Each of the thread engaging plates 61 has an upper part bent in an inverted L-shaped configuration, so that a gap is formed between the upper part of each thread engaging plate 61 and the upper surface of the base plate 62. Friction members (not shown) are fixed to the upper surface of the base plate 62 and the lower surface of the upper part of each thread engaging plate 61 as by adhesive, etc. so as to prevent the upper thread from easily slidably moving along these surfaces and to enhance the ability of these surfaces to hold the upper thread.

As will be explained later, the thread engaging member 60 is positioned within a moving path of the presser foot 36 for giving refuge to the upper thread and is positioned adjacent the refuge position of the presser foot 36, so that the foot part 37 may pass through the gap between the base plate 62 and the upper part of the engaging plate 61 corresponding to the selected one of the needle bars 14.

The operation of the above embodiment will now be explained.

For the sewing operation, the main shaft 20 is rotatably driven, and the selected one of the needle bars 14 is vertically reciprocally moved as the needle bar drive cam 22 is rotated with the main shaft 20. On the other hand, the presser foot unit 30 is vertically reciprocally moved in synchronism with the vertical movement of the selected needle bar 14 as the presser foot drive cam 24 is rotated with the main shaft 20. Thus, the presser foot 36 is vertically reciprocally moved between an upper dead center indicated by solid lines and a lower dead center indicated by chain lines in FIG. 1.

During the sewing operation, the presser foot unit 30 is vertically moved with both upper and lower projections 32 of the vertically movable element 31 being always in engagement with the straight lower portion of the guide slot 13*a*. Therefore, the presser foot 36 is vertically moved with its foot part 37 held in the horizontal position.

Figure 5:
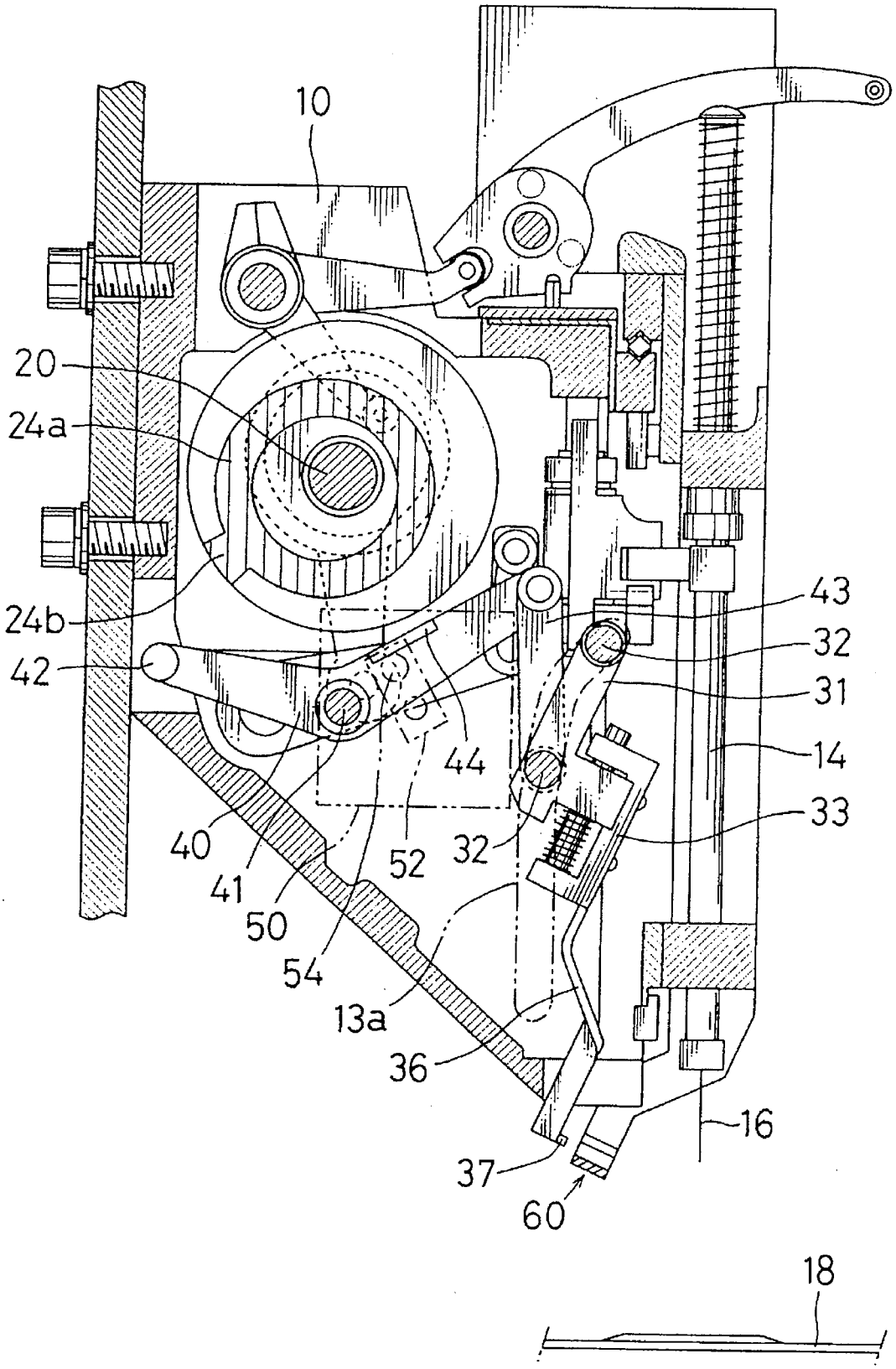
FIG. 5 is a side sectional view similar to FIG. 1 but showing the operation for moving the presser foot to a refuge position.

When the sewing operation is completed, the rotation of the main shaft 20 is stopped after both the selected needle bar 14 and the presser foot unit 30 are positioned in their upper dead centers. Then, a thread cutting mechanism (not shown) is actuated to cut the upper thread in a position below the throat plate 18. Thereafter, the pulse motor 50 is started to pivot the actuation arm 52, so that the abutting member 44 of the drive arm 40 is lifted by the actuation arm 52 by means of the roller 54. Thus, as the drive arm 40 is pivoted from the position shown in FIG. 1 to the position shown in FIG. 5, the presser foot unit 30 or the presser foot 36 is moved upwardly beyond the upper dead center of the reciprocal movement, and the cam follower 42 of the drive arm 40 is moved to pass through the cut-out recess 24*b* of the presser foot drive cam 24 so as to be disengaged from the cam recess 24*a*. As the result, the power transmission path from the main shaft 20 to the presser foot unit 30 or the presser foot 36 is interrupted.

As the presser foot 36 is thus moved upwardly, the projections of the vertically movable element 31 enter the curved upper portion of the guide slot 13*a*, so that the presser foot unit 30 is gradually inclined toward the forward direction with the foot part 37 inclined rearwardly along an arcuate path. When the presser foot unit 30 reaches its uppermost position shown in FIG. 5, the presser foot 36 reaches the refuge position which is spaced rearwardly from the reciprocating path of the selected needle bar 14. When the presser foot 36 is brought to approach the refuge position, the foot part 37 of the presser foot 36 passes through the gap between the base plate 62 of the thread engaging member 60 and the upper part of the thread engaging plate 61 corresponding to the selected needle bar 14.

The above operation will be explained in detail with reference to FIGS. 6(A) to 6(E). FIG. 6(A) shows the state where the presser foot 36 is stopped at its upper dead center of the reciprocal movement for the sewing operation and where the upper thread has been cut by the thread cutting mechanism. A part Y of the upper thread left on the side of the sewing needle 16 after the cutting operation (hereinafter called "upper needle thread Y") extends downwardly from the sewing needle 16 to a position below the throat plate 18 through the insertion hole formed in the foot part 37 of the presser foot 36. As the presser foot 36 is moved toward the refuge position, the foot part 37 moves together with the upper needle thread Y in sequence as shown in FIGS. 6(B) and 6(C) and passes through the gap between the base plate 62 and the upper part of one of the thread engaging plates 61 of the thread engaging member 60. The foot part 37 then reaches the position shown in FIG. 6(D) which corresponds to the refuge position of the presser foot 36. In the state shown in FIG. 6(D), the cut end of the upper needle thread Y is engaged by the thread engaging member 50 but is still inserted into the insertion hole of the presser foot 36. Therefore, in case of a sewing head having a single needle bar 14, it is not necessary to include the thread engaging member 60 since the cut end of the upper needle thread Y is engaged by the presser foot 36 in a position rearwardly away from the position below the needle bar 14.

With the multi-needle sewing head of this embodiment, when the needle bar case 12 is slidably moved under control for selecting another needle bar 14, the thread engaging member 60 is moved with the needle bar case 12, so that the cut end of the upper needle thread Y is automatically removed from the insertion hole of the foot part 37 as shown in FIG. 6(E), and that the upper needle thread Y is held by the thread engaging member 60.

Figure 7:
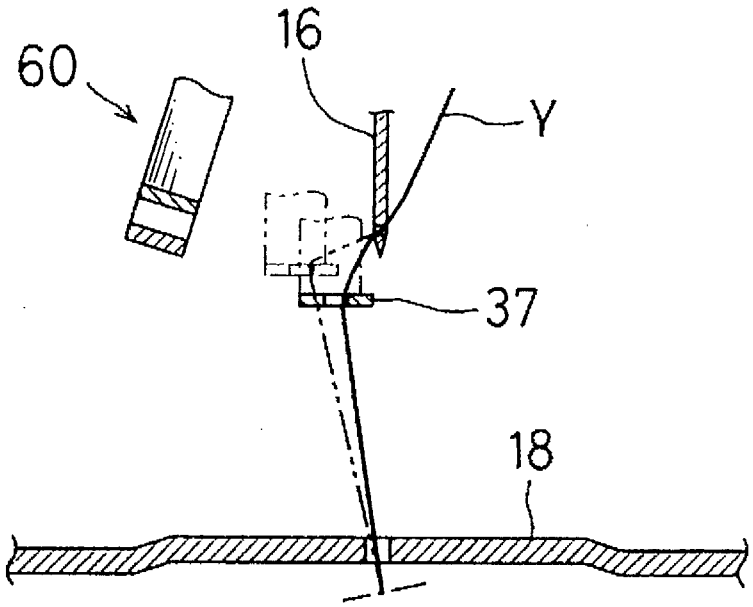
FIG. 7 is an explanatory view showing an operation for adjusting the length of an upper needle thread.

In addition, with this embodiment, the length of the upper needle thread Y from the sewing needle 16 can be adjusted. Thus, the presser foot 36 is moved to a position shown by solid lines in FIG. 7 toward the refuge position prior to the cutting operation, so that the upper thread is drawn out from an upper thread supply device (not shown) for supplying the upper thread to the sewing needle 16. The thread cutting device is then operated to cut the upper thread, so that the length of the upper needle thread Y becomes longer by the length drawn out from the upper thread supply device. Such length becomes greater when the presser foot 36 is moved to a position shown by chain lines in FIG. 7. Thus, by controlling the amount of movement prior to the cutting operation of the presser foot 37 or the presser foot unit 30 toward the refuge position, the length of the upper needle thread Y from the sewing needle 16 can be adjusted.

Second Embodiment

A second embodiment of the present invention will now be explained with reference to FIGS. 8 to 10. This embodiment is a modification of the first embodiment, and like members are given the same reference numerals and their description will not be repeated.

Figure 8:
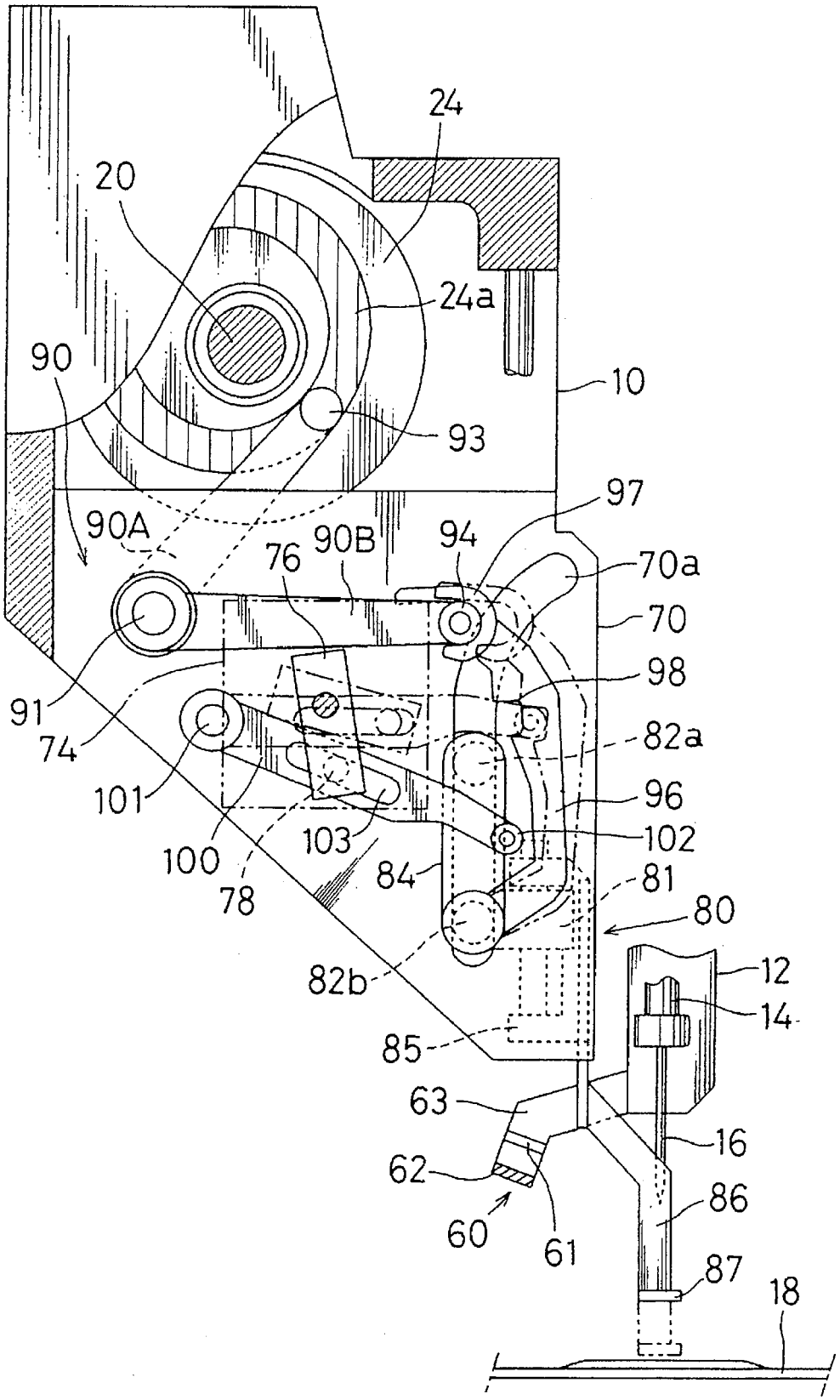
FIG. 8 is a side sectional view of a sewing head of a sewing machine according to a second embodiment of the present invention.
Figure 9:
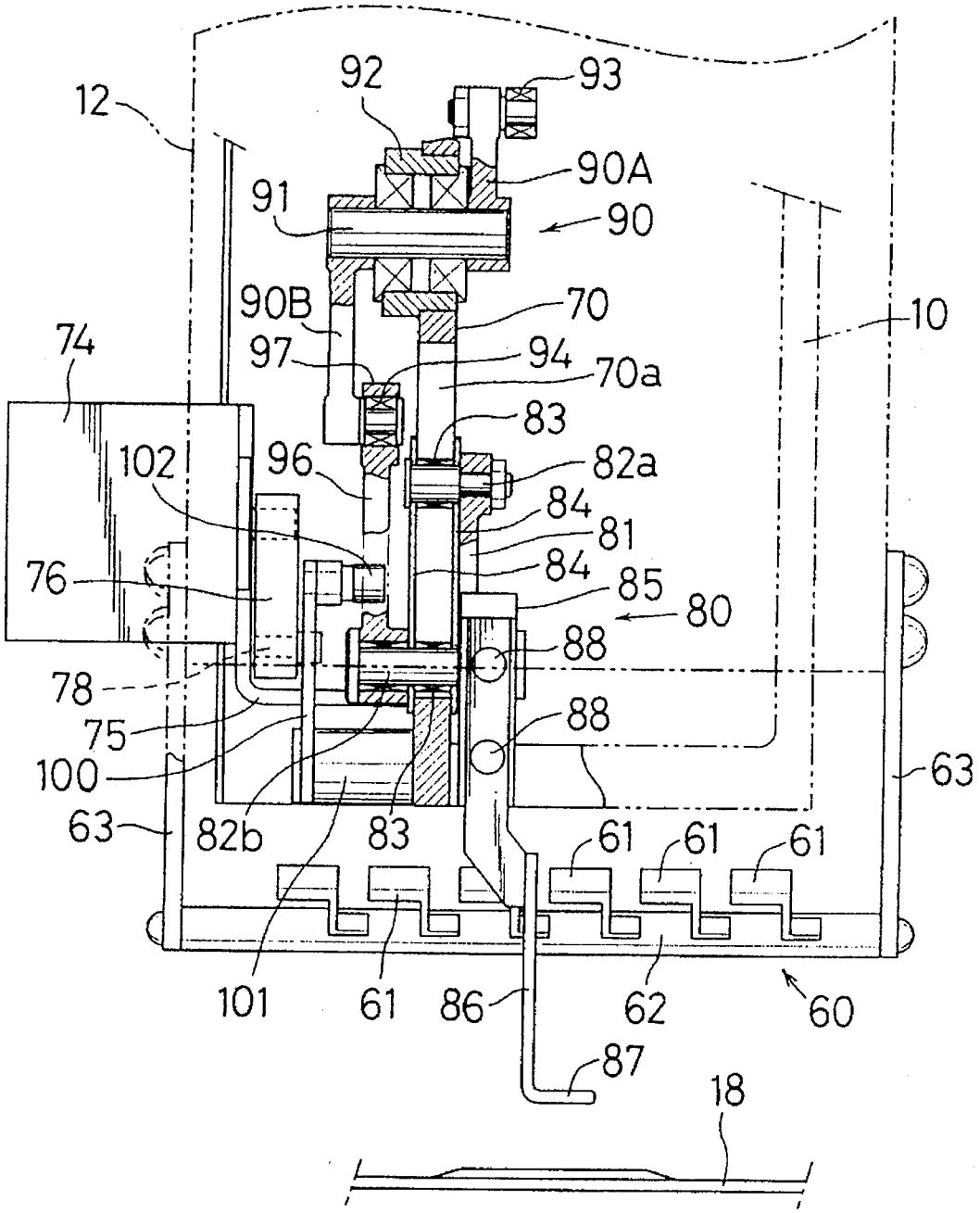
FIG. 9 is a front view and its associated mechanisms of the sewing head shown in FIG. 8.

FIGS. 8 and 9 show a side sectional view and a front view of a sewing head of a sewing machine of the second embodiment. As will be seen from these drawings, the presser foot drive cam 24 of this embodiment does not include the cut-out recess 24*b* which is provided in case of the first embodiment. Alternatively, a link mechanism between the presser foot drive cam 24 and a presser foot 86 is so constructed as to be disconnected when the presser foot 86 is moved to a refuge position. The description of the second embodiment will be given mainly in connection with the construction other than the construction explained in the first embodiment.

A base 70 is fixed to the machine arm 10 and includes a guide slot 70*a* similar to the guide slot 13*a* of the first embodiment. A presser foot unit 80 includes a vertically movable element 81 which includes an upper pin 82*a* and a lower pin 82*b* fixed thereto. Each of the upper pin 82*a* and the lower pin 82*b* has a bearing 83 mounted thereon and is in engagement with the guide slot 70*a* by means of the bearing 83. A pair of plates 84 are mounted on the upper pin 82*a* and the lower pin 82*b* such that the plates 84 are positioned on both sides of the base 70 and that each of the upper pin 82*a* and the lower pin 82*b* is positioned between the plates 84. With this construction, the vertically movable element 81 can be moved along the guide slot 70*a* with the position being held in a stable manner.

In other respects, the presser foot unit 80 is substantially the same as the presser foot unit 30 of the first embodiment. Thus, the presser foot unit 80 has a support element 85 as well as the presser foot 86. The presser foot 86 has a foot part 87 at its lower end and is fixed to the front surface of the support element 85 by means of screws 88.

A presser foot drive mechanism for driving the presser foot unit 80 will now be explained. As shown in FIG. 9, a shaft 91 is rotatably supported on the base 70 by means of a bearing 92. A drive arm 90 has a first arm part 90A and a second arm part 90B which are fixed to one end and the other end of the shaft 91, respectively. A cam follower 93 is mounted on one end of the first arm part 90A and is in engagement with the cam recess 24*a* of the presser foot drive cam 24. A roller 94 is mounted on one end of the second arm part 90B.

An interlocking lever 96 has a lower end which is pivotally connected to the lower pin 82*b* of the vertically movable element 81. The interlocking lever 96 has an upper end formed with an arc-shaped connecting portion 97 which is in engagement with the roller 94 of the second arm part 90B. Here, the interlocking lever 96 is biased by a torsion spring (not shown) in a direction to normally keep engagement of the connecting portion 97 with the roller 94.

When the presser foot drive cam 24 is rotated with the main shaft 20, the drive arm 90 is reciprocally pivoted about an axis of the shaft 91, so that the presser foot unit 80 or the presser foot 86 is vertically reciprocally moved between the upper dead center shown by solid lines and the lower dead center shown by chain lines in FIG. 8.

A refuge lever 100 is pivotally supported on the base 70 by means of a shaft 101 and is positioned below the drive arm 90. The refuge lever 100 has a roller 102 mounted on one end thereof. An elongated engaging slot 103 is formed in the middle portion of the refuge lever 100. An engaging recess 98 is formed in the middle portion of the interlocking lever 96 for engagement with the roller 102 as will be explained later.

As shown in FIG. 9, a pulse motor 74 is fixed to the base 70 by means of a bracket 75 and serves as an actuator for moving the presser foot unit 80 or the presser foot 86 to the refuge position. An actuation arm 76 is fixed to an output shaft of the pulse motor 74. A pin 78 is fixed to one end of the actuation arm 76 and is in engagement with the engaging slot 103 of the refuge lever 100.

Here, the pulse motor 74 normally holds the refuge lever 100 in a position shown by solid lines in FIG. 8 so as to prevent the roller 102 of the refuge lever 100 from interference with the interlocking lever 96 when the interlocking lever 96 is reciprocally driven.

The thread refuge operation performed by the presser foot 86 will now be explained.

When the sewing operation has been completed, the presser foot unit 80 is stopped at its lower dead center, and then, the upper thread is cut by the thread cutting device. Thereafter, the pulse motor 74 is started to pivot the refuge lever 100, so that the interlocking lever 96 is pushed by the refuge lever 100 by means of the roller 102 mounted on one end of the refuge lever 100, and that the interlocking lever 96 is pivoted about the axis of the pin 82*b*. When the roller 102 is brought in engagement with the engaging recess 98 of the interlocking lever 96 as shown in FIG. 10, the connecting portion 97 of the interlocking lever 96 is disengaged from the roller 94 of the second arm part 90B, so that the power transmission path between the main shaft 20 and the presser foot unit 80 or the presser foot 86 is interrupted.

Figure 10:
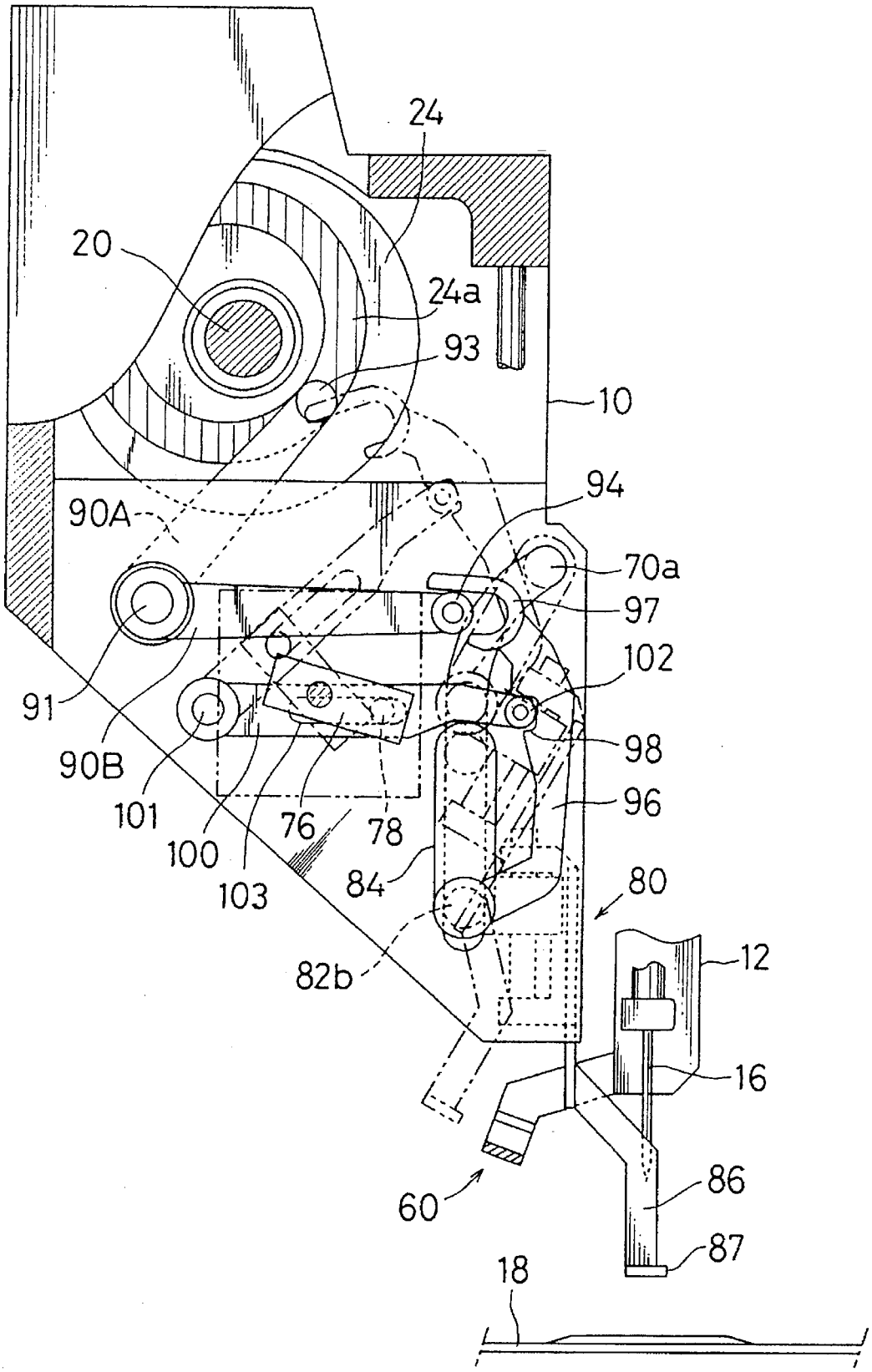
FIG. 10 is a view similar to FIG. 8 but showing the operation for moving the presser foot to a refuge position.

As the refuge lever 100 is further pivoted by the pulse motor 74, the interlocking lever 96 is lifted by virtue of engagement between the roller 102 and the engaging recess 98, so that the presser foot unit 80 or the presser foot 86 is moved from the upper dead center (the position at the time when the sewing operation has been completed) to the refuge position shown by chain lines in FIG. 10 where the presser foot 86 is positioned rearwardly of the reciprocating path of the selected needle bar 14. When the presser foot 86 approaches the refuge position, the foot part 87 passes through the gap between the base plate 62 and the upper part of the thread engaging plate 61 corresponding to the selected needle bar 14, so that the cut end of the upper needle thread is held by the thread engaging member 60.

Although the sewing machines of the above first and second embodiments are those having one sewing head, the same construction can be adapted to a multi-head sewing machine having a plurality of sewing heads which are driven by a single drive source or one main shaft 30. Particularly, in case of the multi-head sewing machine, the transmission of driving force from the main shaft 20 to the presser foot unit 30 or 80 can be interrupted in each sewing head when the presser foot 46 or 86 of that sewing head is moved to the refuge position. Therefore, when the sewing machine is controlled such that only the selected sewing head(s) is(are) driven for performing the sewing operation, the presser foot unit 30 or 80 of the remaining sewing head(s) can be held in the refuge position and can be held not to be reciprocally driven.

While the invention has been described with reference to preferred embodiments thereof, it is to be understood that modifications or variations may be easily made without departing from the spirit of this invention which is defined by the appended claims.

What is claimed is:

1. In a sewing machine having at least one sewing head in which a presser foot is vertically reciprocally moved by a predetermined stroke in synchronism with a vertical movement of a needle bar and in which an upper thread is cut after completion of the sewing operation and in a position spaced by a suitable distance from a sewing needle mounted on the needle bar, the improvement comprising:

refuge means operable to move the presser foot to a refuge position for giving refuge to a part of the upper thread on the side of the sewing needle cut after completion of the sewing operation, the refuge position being out of the predetermined stroke.

2. The sewing machine as defined in claim 1 wherein the presser foot is reciprocally driven by a main shaft by means of power transmission means, said power transmission means being operable to convert rotation of the main shaft into the vertical reciprocating movement of the presser foot, and wherein said refuge means is operable to interrupt the power transmission path of said power transmission means between the main shaft and the presser foot when the presser foot is moved to the refuge position.

3. The sewing machine as defined in claim 2 wherein said power transmission means is operable to convert the rotation of the main shaft into the vertical reciprocating movement of a presser foot unit having the presser foot mounted thereon, wherein said power transmission means includes guide means for guiding said presser foot unit together with the presser foot along a guide path including a stroke path part for the vertical reciprocating movement of the presser foot, and wherein said refuge means is operable to move said presser foot to a path part of said guide path other than said stroke path part.

4. The sewing machine as defined in claim 3 wherein said power transmission means includes cam means for converting the rotation of the main shaft into a reciprocal pivotal movement of a drive arm, wherein said presser foot unit is connected to one end of said drive arm, and wherein said refuge means includes an actuator for moving said presser foot unit by means of said drive arm.

5. The sewing machine as defined in claim 4 wherein the transmission path between said cam means and said drive arm is interrupted when the presser foot is moved to the refuge position by said refuge means.

6. The sewing machine as defined in claim 3 wherein said power transmission means includes cam means for converting the rotation of the main shaft into a reciprocal pivotal movement of a drive arm, wherein said presser foot unit is connected to said drive arm by means of an interlocking arm which is disengageably connected to said drive arm, and wherein said refuge means is operable to move said interlocking arm to a position to be disengaged from said drive arm and is operable to move said presser foot unit together with said presser foot unit to the refuge position by means of said interlocking arm.

7. The sewing machine as defined in claim 1 further including thread engaging means positioned on a path of movement of the presser foot toward the refuge position, said thread engaging means being operable to receive the part of the upper thread from the presser foot and to hold the part in position.

8. The sewing machine as defined in claim 7 wherein the presser foot includes an insertion hole for permitting passage of the sewing needle, so that the part of the upper thread cut after completion of the sewing operation extends downwardly from the insertion hole of the presser foot, and wherein said thread engaging means is operable to remove the part of the upper thread from the insertion hole of the presser foot so as to hold the same when the presser foot is moved to the refuge position.

* * * * *